United States Patent [19]

Goldfein

[11] 3,977,259

[45] Aug. 31, 1976

[54] PUMPING APPARATUS

[75] Inventor: Harold A. Goldfein, Lincolnwood, Ill.

[73] Assignee: Inca Inks, Inc., Northbrook, Ill.

[22] Filed: Feb. 1, 1973

[21] Appl. No.: 328,544

[52] U.S. Cl. ..... 74/41; 92/165 R

[51] Int. Cl.[2] ..... F16H 21/32

[58] Field of Search ..... 74/41; 92/118, 165, 92/165 R, 166; 91/218, 303, 304, 176, 196

[56] References Cited

UNITED STATES PATENTS

| | | | |
|---|---|---|---|
| 2,199,821 | 5/1940 | Hadgood | 92/166 |
| 2,286,153 | 6/1942 | Nicolescu | 74/41 |
| 2,456,531 | 12/1948 | Patterson | 74/41 |
| 2,871,072 | 1/1959 | Parks et al. | 92/118 |
| 3,139,762 | 7/1964 | Alfieri | 92/165 |
| 3,150,602 | 9/1964 | Tyree, Jr. | 92/165 |
| 3,168,014 | 2/1965 | Aslan | 92/118 |

*Primary Examiner*—Benjamin W. Wyche
*Assistant Examiner*—Wesley S. Ratliff, Jr.
*Attorney, Agent, or Firm*—Lockwood, Dewey, Zickert & Alex

[57] ABSTRACT

A double-acting hydraulic cylinder unit imparts rocking movement to the walking beam of well pumping apparatus and has either (1) a stationary piston and a generally vertically reciprocating cylinder or (2) a stationary cylinder and a generally vertically reciprocating piston. Upper and lower piston rods of equal size extend from opposite sides of the piston and project through the upper and lower ends, respectively, of the cylinder. In one arrangement the lower end of the lower piston rod is pivotally anchored so as to pivotally absorb both compression and tension forces transmitted through the lower piston rod while the upper piston rod is not anchored and the primary function of the upper piston rod is to provide for equal displacement of fluid on opposite sides of the piston during vertical reciprocation of the piston. In the second arrangement the upper end of the upper piston rod is pivotally connected to the walking beam while the lower piston rod is not anchored and its primary function is to provide for equal displacement of fluid on opposite sides of the piston during vertical reciprocation thereof.

13 Claims, 6 Drawing Figures

PUMPING APPARATUS

This invention relates generally to innovations and improvements in the hydraulic operating mechanism for reciprocating the walking beam of a well pumping apparatus of the type wherein so-called horseheads are mounted on opposite ends of the rocking beam which is usually pivotally mounted on a Samson post and the pollish rod is connected to one of the horseheads and counterweights are suitably connected to the other horsehead.

More specifically the present invention relates to improvements and innovations in the hydraulic operating mechanism for such a well pumping apparatus which includes a double-acting cylinder unit wherein either the piston is stationary and the cylinder housing the piston is vertically reciprocable or the cylinder is stationary and the piston is vertically reciprocable. In each arrangement equal sized piston rods extend from opposite sides of the piston and project through the opposing ends of the cylinder. In the arrangement in which the cylinder is verrtically reciprocable and the piston is stationary the lower end of the lower piston rod is pivotally anchored so as to pivotally absorb both compression and tension forces exerted on it by the piston while the upper end of the upper piston rod is unanchored and, therefore, not capable of absorbing or transmitting compression or tension forces. Conversely, in the arrangement wherein the cylinder is stationary and the piston is vertically reciprocable the cylinder is pivotally anchored below the lower end thereof while the lower end of the lower piston rod is unanchored and not capable of absorbing or transmitting either compression or tension forces.

Certain additional improvements and innovations pertain to the linkage interconnecting the upper end of the reciprocating cylinder with the rocking beam and a means for guiding the free ends of the unanchored piston rods.

The object of the invention, generally stated, is the provision of an improved hydraulically operated system for imparting rocking movement to the walking beam of a wall pumping apparatus which is characterized by a double-acting cylinder having in one arrangement a stationary piston and a vertically reciprocal cylinder which houses the piston and is operatively linked or connected to the walking beam, and wherein the piston is stationarily anchored by means of the lower piston rod alone while the upper piston rod is inactive but is of the same size as the lower piston rod so that equal amounts or volumes of fluid are displaced and introduced into the double-acting cylinder unit on opposite sides of the piston during its operation but substantially no wear due to its side thrust is imparted to either the piston rods or to the glands or bushings through which they project at opposite ends of the reciprocating cylinder and in a second equivalent arrangement having the cylinder stationary and the piston vertically reciprocable and wherein the lower end of the cylinder is pivotally anchored, the upper piston rod is pivotally connected to the walking beam and the lower end of the lower piston rod is unanchored.

Certain other more specific objects of the invention will appear hereinafter. For a more complete understanding of the nature and scope of the invention reference may now be had to the following detailed description of two preferred embodiments thereof taken in connection with the accompanying drawings wherein.

Figures 1, 2, 3, 4:
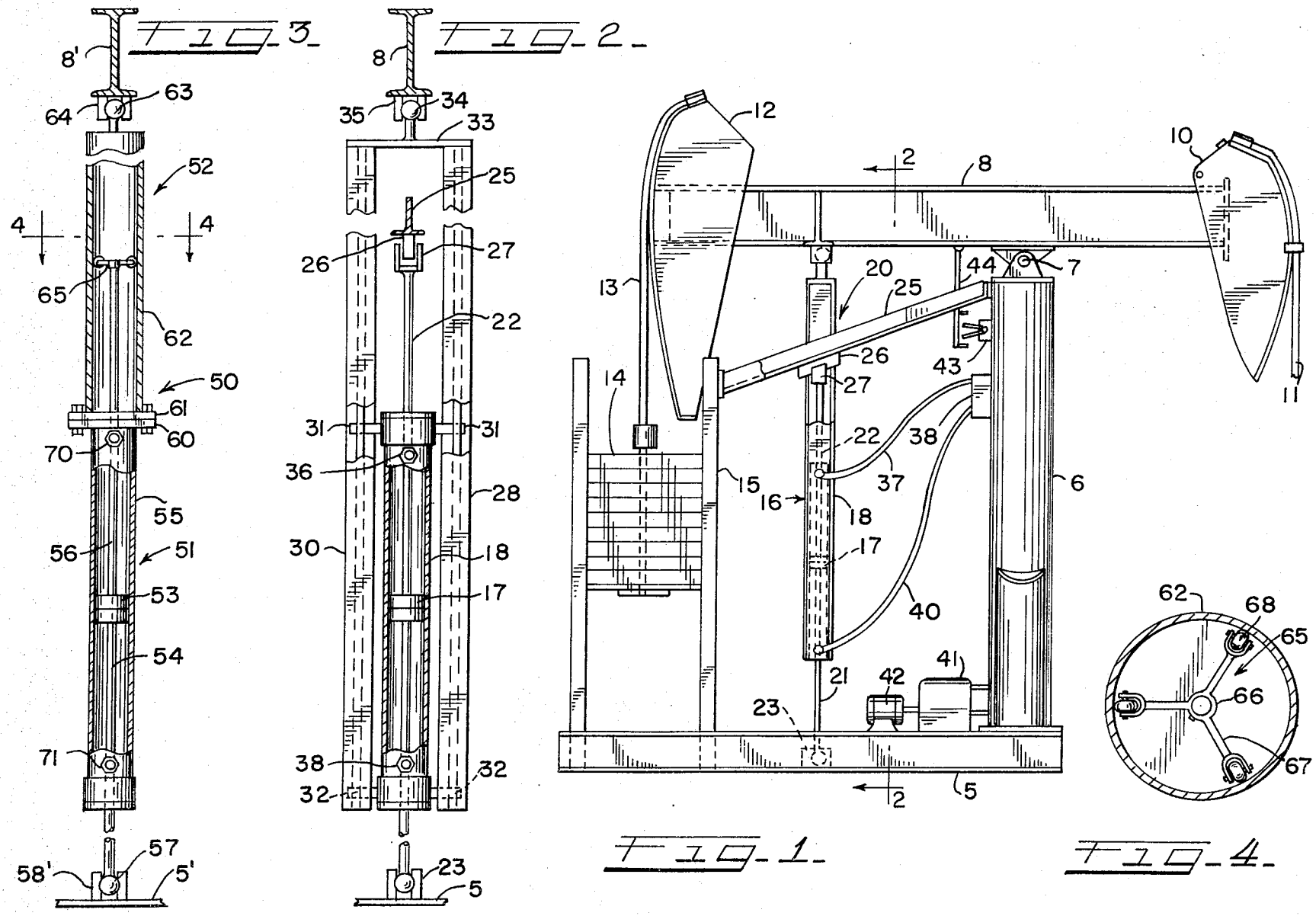
FIG. 1 is a side elevational view, certain parts being broken away or omitted, of a well pumping apparatus having a double-acting hydraulic cylinder unit operatively connected to the rocking beam in accordance with one embodiment of the present invention.
FIG. 2 is a view partly broken away taken on lines 2—2 of FIG. 1.
FIG. 3 is a view generally corresponding to FIG. 2 showing a different embodiment of the invention.
FIG. 4 is a sectional view on enlarged scale taken on line 4—4 of FIG. 3.

The well pumping apparatus or installation in FIGS. 1 and 2 comprises a platform adjacent one end of which is mounted on a Samson post 6 having pivotally mounted at 7 on the upper end thereof a rocking beam 8. At its right hand end the walking beam 8 carries a horsehead 10 to which is attached a cable 11 connected with a polish rod for the well. At its left end the walking beam 8 is provided with a horsehead 12 to which is attached a cable 13 connected with the counterweights 14 which are vertically reciprocable in the guide framework 15.

The arrangement thus far described in connection with FIGS. 1 and 2 is conventional and representative of this type of well pumping apparatus or installation.

In the apparatus shown in FIGS. 1 and 2 the rocking movement is imparted to the walking beam 8 by a double-acting hydraulic cylinder unit indicated generally at 16. The unit 16 comprises a stationary piston 17 which is housed within a vertically reciprocating cylinder 18 the upper end of which is suitably linked or operatively connected by linkage means indicated generally at 20 to the underside of the rocking beam 8.

A lower piston rod 21 extends from the underside of the piston 17 while an upper piston rod 22 extends from the upperside. These piston rods 21 and 22 project through the upper and lower ends of the cylinder 18, respectively, through fluid tight glands or seals of known type. The lower piston rod is pivotally connected at its lower end by means of a ball and socket universal joint indicated at 23 to the platform 5 whereby the universal joint is capable of pivotally resisting both downward compression and upward tension forces transmitted through the lower piston rod 21.

While the upper piston rod 22 has the same size as the lower piston rod 21, it does not transmit appreciable compression or tension forces since the upper end is not anchored but is free to shift and move a sufficient amount to prevent any anchoring or restraint or sidewise thrust thereon. Since the upper piston rod 22 is not required to transmit tension or compression forces, it can be made substantially less strong than the lower piston rod 21. For example, the upper piston rod 22 may be thin wall tubing having the same outside diameter as the diameter of the lower connecting rod or piston rod 21 which will usually be solid. By having equal volumes of hydraulic fluid delivered into and expelled from the chambers on opposite sides of the piston 17 the hydraulic system is considerably simplified due to the balanced loading. Furthermore, the speed of one stroke may be increased or decreased relative to the other.

A brace 25 extends on an incline between the upper end of the Samson post 6 and the vertical framework 15 for the counterweights 14 and is positioned directly over the double-acting cylinder 16. A guide flange 26 depends from the underside of the brace 25 and cooperates with a slotted or channel-shaped guide 27 which is mounted on the upper end of the upper piston rod 22. It will be seen from FIG. 2 that there is appreciable clearance between the stationary flange guide 26 and the channeled, grooved or slotted guide member 27. This permits some side play between these parts 26 and 27 while the relative movement between these parts from left to right as viewed in FIG. 1 is not restrained. It will be seen that since no restraint is placed on the upper end of the upper piston rod 22 no side thrust will be imparted to the seal or gland in the upper end of the cylinder 18 through which the piston rod passes.

The linkage 20 which interconnects the double-acting cylinder 18 with the walking beam 8 comprises a pair of rigid I-beam members 28 and 30 attached to opposite sides of the cylinder 18 at the upper and lower ends thereof by means of fixed pins 31—31 and 32—32. The I-beams 28 and 30 extend upwardly beyond the upper end of the cylinder 18 and at their upper ends are provided with a fixture 33 which carries the ball 34 of a universal joint the socket 35 of which is mounted on the underside of the walking beam 8.

The port 36 (FIG. 2) of the cylinder 18 is connected by a flexible hydraulic fluid pressure hose 37 (FIG. 1) to a valve block of known type indicated diagrammatically at 38 mounted on the side of the Samson post 6. Similarly, the lower port 38 of the cylinder 18 is connected by means of a flexible hydraulic fluid pressure line 40 to the valve block 38. A hydraulic pump is indicated at 41 driven by an electric motor 42 and suitably connected through the Samson post to the valve block 38. The reversing of the rocking movement of the walking beam 8 is obtained by means of a reversing control valve unit of known type indicated diagrammatically at 43 mounted on the Samson post 6 and actuated by a vertically reciprocating rod 44 pivotally connected to the underside of the walking beam 8. One suitable form of reversing valve unit 43 and actuating rod 44 is described in detail in Maasshoff U.S. Pat. No. 3,580,138 dated May 25, 1971.

It will be understood that the hydraulic system operates to deliver hydraulic fluid under pressure alternately into the upper and lower ports 36 or 38 while the hydraulic fluid is expelled through the opposite port. For example, in order to rock the walking beam in a clockwise direction as viewed in FIG. 1 hydraulic fluid will be introduced through the line 37 and upper port 36 into the upper chamber of the cylinder 18. Since the piston 17 is stationary, the pressure acting on the underside of the upper end of the cylinder 18 will force the cylinder 18 upwardly thereby rocking the walking beam in a clockwise direction. At this movement occurs, it will be apparent that fluid within the lower chamber underneath the piston 18 will be expelled through the port 38 and through the flexible line 40. Reverse rocking action occurs when pressurized fluid is introduced in the lower port 38 and expelled through the upper port 36.

The present invention is not concerned with the particular details of the hydraulic circuit or system and for a more detailed description of a suitable system for this purpose reference is made to Hawk U.S. Pat. No. 3,369,490 dated Feb. 20, 1968.

When pressure is being introduced through port 36 into the upper chamber of the cylinder 18, it acts on the upper side of the piston 17 and the lower piston rod 21 is placed under compression. Conversely, when hydraulic fluid under pressure is introduced through the lower port 38 into the lower chamber, the pressure acts on the underside of the piston 18 and the lower piston rod 21 is placed under tension. As the cylinder 18 reciprocates in generally a vertical direction and as the walking beam 8 has rocking movement imparted to it, it will be seen that the entire double-acting cylinder unit 16 together with the linkage 20 swings somewhat to the left and right above the pivot provided by the lower universal joint 23. Thus, when the walking beam 8 has rocked to the position where the horsehead 10 is at its low point and horsehead 12 is at its high point, the hydraulic cylinder unit 16 and linkage 20 will have swung or tilted slightly to the right. On the other hand, when the horsehead 10 is in its upper most position and the horsehead 12 is in its lowest position, then the hydraulic cylinder 16 and linkage 20 will have swung slighly to the left. However, intermediate these tilted positions of the walking beam 8 it will be apparent that the hydraulic cylinder unit 16 will have passed through the generally vertical position as shown in FIG. 1. Preferably, when the hydraulic cylinder unit is at the midpoint of its movement it will tilt or lean slightly to the left so that the cylinder movement during a complete stroke is equal on each side of a vertical line from the pivot point of universal joint 23.

The guiding action provided between the guide flange 26 and the slotted or channel-guide member 27 allows for this swinging movement without placing appreciable restraint or sidewise thrust on the upper piston rod 22. While the lower end of the piston rod 21 is not free to move but is anchored in place, the pivoting action allows relative movement to take place between the lower end of the cylinder 18 and the piston rod 21 without imparting any binding or sidewise thrust thereto where it passes through the seal or gland in the lower end of the piston. Accordingly, no unusual amount of wear is imparted to the hydraulic cylinder unit due to the piston 17 being anchored.

Referring to FIGS. 3 and 4 of the drawings, an alternate form of double-acting hydraulic cylinder means and associated linkage is indicated generally at 50 which may be used in place of the double-acting hydraulic cylinder means 16. However, when the alternate double-acting hydraulic cylinder unit and linkage 50 is used, the brace 25 will be omitted or else it will be replaced by an alternate brace which will accommodate the means 50. The means 50 comprises a double-acting cylsinder unit indicated generally at 51 and linkage means indicated generatlly at 52.

The double-acting cylinder unit 51 comprises a stationary piston 53 having a lower piston rod 54 connected to the underside thereof and projecting through the lower end of the vertically reciprocal cylinder 55. An upper piston rod 56 extends from the upper side of the piston 53 and projects through the upper end of the cylinder 55. The lower or bottom end of the lower piston rod 54 is provided with a ball 57 comprising one part of a universal joint in the socket portion of which is indicated at 58 mounted on the platform 5'.

The upper end of the cylinder 55 is provided with a plate 60 to which is bolted a mating plate 61 mounted on the bottom end of a pipe section 62. At its upper end the pipe 62 is provided with a ball 63 forming a portion of a universal joint the socket portion of which is indicated at 64 mounted on the underside of the walking beam 8'.

A spider 65 is mounted on the upper end of the upper piston rod 56 and comprises a hub portion 66 supporting radially projecting arms 67 with casters 68-68 pivotally mounted on the distal ends thereof for rolling engagement with the interior of the pipe section 62.

It will be understood that the upper port 70 of the cylinder 55 may be connected to the pressure line 37 while the lower or bottom port 71 is connected with the pressure line 40.

The piston rod 56 will have the same size as the piston rod 54 so that the volumes of fluid introduced and expelled into the upper chamber above the piston 53 will be equal to those introduced and expelled from the bottom chamber below the piston.

In operation hydraulic fluid under pressure is alternately introduced into one of the ports 70 or 71 and expelled through the other thereby vertically reciprocating the cylinder 55 and imparting rocking movement to the walking beam 8' through the linkage 52 consisting of the pipe section 62 and the universal joint 63–64. The lower end of the bottom piston rod 54 is pivotally anchored so as to resist and absorb compression and tension forces imposed on the lower piston rod 54 by pressure acting alternately on opposite sides of the piston 53. The complete assembly 50 is thus capable of having the required swinging movement in a left to right direction as viewed in FIG. 1 without any side thrust being placed on either of the piston rods 54 or 56. Accordingly no more than normal wear will occur between the piston rods and the glands or seals in the opposite ends of the vertically reciprocal cylinder 55.

Figure 5:
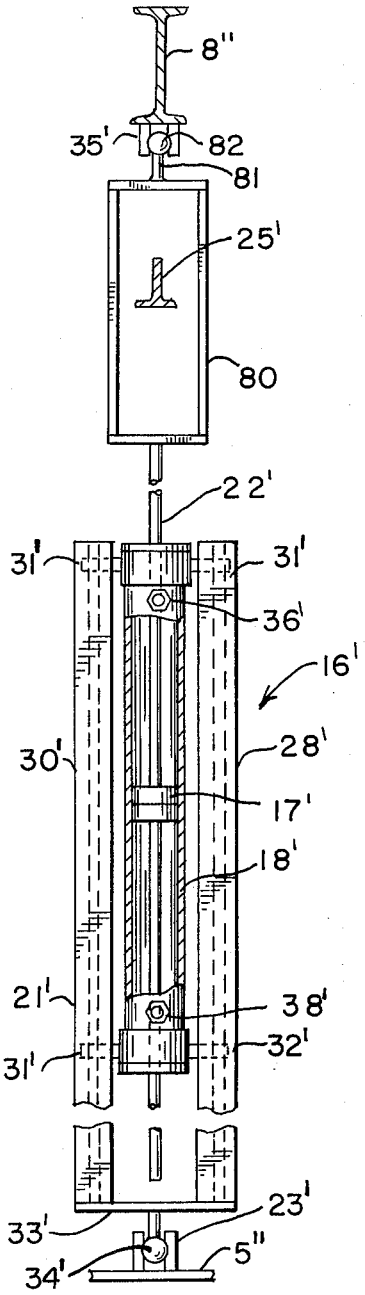
FIG. 5 is a view corresponding to FIG. 2 of an embodiment in which the cylinder is anchored and stationary while the piston reciprocates.

The advantages of the invention are also obtainable in modifications wherein the cylinder of the double-acting hydraulic cylinder is anchored and stationary while the piston reciprocates and is operatively connected to the walking beam. In FIG. 5 one such modification of the invention is shown which corresponds to the embodiment shown in FIGS. 1 and 2 but with the cylinder anchored and the piston operatively connected to the walking beam 8''. In FIG. 5 double-acting hydraulic cylinder is indicated generally at 16' with its piston indicated at 17' and the cylinder housing indicated at 18'. The upper and lower hydraulic fluid connections to the cylinder 18' are indicated at 36' and 38', respectively. A pair of channel members 28' and 30' are attached to opposite sides of the cylinder 18' by means of the upper and lower pins 30'-31' and 32'–32' projecting diametrically at ends of the double-acting cylinder unit 16'. A cross plate 33' extends across and is fastened to the lower ends of the side members 28' and 30' and carries a depending pin which carries the ball member 34' which fits in ball-and-socket relationship into the socket member 23' attached to the base 5''. It will be seen that the ball 34' together with the socket 23' constitute a universal joint that permits pivoting of the double-acting hydraulic cylinder 16' in all directions around the center of the ball 34'. A lower piston rod 21' is secured at one end to the underside of the piston 17' while the opposite end projects through the lower end of the cylinder unit 16' where it reciprocates freely. The upper piston rod 22' is connected to the upper side of the piston 17' and projects upwardly through the upper end of the double-acting cylinder unit 16' and is connected to the walking beam 8'' by an elongated frame 80 which straddles the brace members 25' so as not to interfere therewith. The link or frame 80 has a pin 81 projecting upwardly from the top side thereof which carries a ball 82 received in ball-and-socket relationship in the socket 35' carried on the underside of the walking beam 8''.

In the foregoing arrangement when the double-acting hydraulic cylinder unit 16' is actuated the piston 17' reciprocates in the anchored cylinder 18'. Since the free piston rod 21' has the same size as the piston rod 22', the vollume of hydraulic fluid admitted and discharged through the cylinder connection 36' and 38' will be equal thereby giving the advantages in operation pointed out above in connection with the embodiment of the invention shown and described in connection with FIGS. 1 and 2. Furthermore, since the cylinder 18' is anchored in the embodiment shown in FIG. 5 has the further advantage that the hydraulic hose connections leading to the connections 36' and 38' will undergo very little movement.

Figure 6:
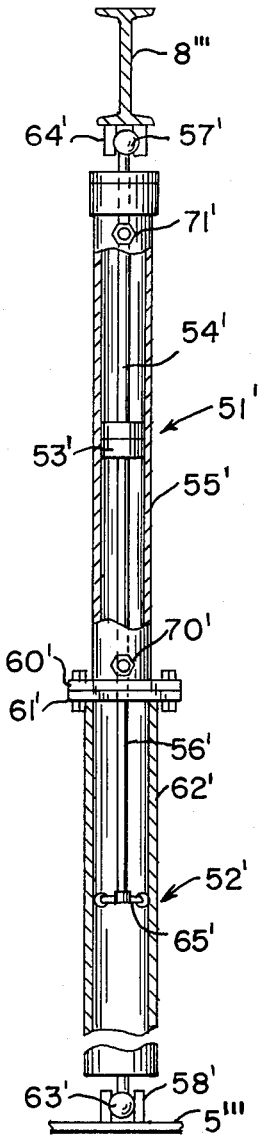
FIG. 6 is a view corresponding to FIG. 3 of another embodiment in which the cylinder is anchored and stationary while the piston reciprocates.

In FIG. 6 an embodiment is shown which corresponds to the embodiment shown in FIGS. 3 and 4 but with the cylinder 55' of the double-acting hydraulic cylinder 51' anchored and with the piston 53' operatively connected to the walking beam 8'''. It will be seen rom FIG. 6 that it corresponds to the embodiment shown in FIGS. 3 and 4 except for the complete reversal of parts intermediate the upper socket 64 and lower socket 58 in FIG. 3.

I claim:

1. In a hydraulically operated system for a well pumping apparatus wherein a counterbalanced walking beam having horseheads mounted on opposite ends with a polish rod operatively connected to one horsehead and counterweights connected to the other is pivotally mounted intermediate its opposite ends on a Samson post for rocking movement solely by the action of double-acting hydraulic cylinder means comprising, a piston which is stationary with respect to a generally vertically reciprocable cylinder housing said piston, upper and lower piston rods of equal size extending from said piston and projecting through the upper and lower ends respectively of said reciprocable cylinder, and linkage means operatively interconnecting said reciprocable cylinder with said walking beam, the improvement comprising means for pivotally anchoring the lower end of said lower piston rod at a fixed pivot point so as to pivotally resist and absorb downward compression and upward tension on said lower piston rod, the upper end of said upper piston rod externally of said cylinder being unanchored with respect to absorbing either tension or compression forces or sidewise thrust.

2. The improvement called for in claim 1 wherein said anchoring means for the lower end of said lower piston rod comprises a universal joint.

3. The improvement called for in claim 1 wherein guide means are provided for the upper end of said upper piston rod.

4. In the hydraulically operated system of claim 1 the further improvement wherein said linkage means operatively interconnecting said reciprocable cylinder with said walking beam comprises, a length of pipe having its lower end rigidly secured to the upper end of said reciprocable cylinder with said pipe and cylinder being substantially co-axial, and a universal joint pivotally interconnecting the upper end of said length of pipe and said walking beam.

5. In said further improvement called for in claim 4, guide means being mounted on the upper end of said upper piston rod so as to maintain said upper end approximately centered within said length of pipe.

6. In said further improvement as called for in claim 5, said guide means comprising a spider member with its hub mounted on said upper end and with a caster on the distal end of each spider arm rollably engaging the inner surface of said length of pipe as the same vertically reciprocates along with said reciprocable cylinder.

7. In a hydraulically operated system for a well pumping apparatus wherein a walking beam is pivotally mounted for rocking movement on a Samson post and has horseheads mounted on opposite ends with a polish rod operatively connected to one horsehead and counterweights connected to the other horsehead, a brace member extends from adjacent the top of said Samson post to framework provided for the counterweights of said apparatus, and double-acting hydraulic cylinder means imparts the rocking movement to said walking beam and comprises a piston which is stationary with respect to a generally vertically reciprocable cylinder which houses said piston, upper and lower piston rods of equal size extending from said piston and projecting through the upper and lower ends respectively of said reciprocable cylinder and linkage means operatively interconnecting said cylinder with said walking beam, the improvement comprising means for pivotally anchoring the lower end of said lower piston rod at a fixed pivot pint so as to pivotally resist and absorb downward compression and upward tension on said lower piston rod, and cooperating guide means on said brace member and upper piston rod for guiding the upper end of said upper piston rod during the swinging movement of said double-acting cylinder means without anchoring said upper end of said upper piston rod externally of the cylinder with respect to absorbing either tension or compression forces or sidewise thrust.

8. In the hydraulically operated system called for in claim 4, the further improvement wherein said linkage means for operatively interconnecting said cylinder with said walking beam comprises, a pair of parallel rigid members rigidly mounted on opposite sides of said cylinder and extending upwardly therefrom on opposite sides of said brace and universal joint means pivotally interconnecting the upper ends of said rigid members to the underside of said walking beam.

9. In a hydraulically operated system for a well pumping apparatus wherein a counterbalanced walking beam having horseheads mounted on opposite ends with a polish rod operatively connected to one horsehead and counterweights connected to the other is pivotally mounted intermediate its opposite ends on a Samson post for rocking movement solely by the action of double-acting hydraulic cylinder means having a cylinder which is stationary with respect to a generally vertical reciprocable piston housed by said cylinder, and upper and lower piston rods of equal size extending from said piston and projecting through the upper and lower ends respectively of said stationary cylinder, the improvement comprising means operatively interconnecting said upper piston rod with said walking beam, and means for pivotally anchoring the lower end of said cylinder at a fixed pivot point with the lower end of said lower piston rod externally of said cylinder being unanchored with respect to absorbing either tension or compression forces or sidewise thrust.

10. The improvement called for in claim 9 wherein said anchoring means for said lower end of said cylinder comprises a universal joint.

11. In the hydraulically operated system of claim 9 the further improvement wherein said means pivotally anchoring the lower end of cylinder comprises a length of pipe having its upper end rigidly secured to the lower end of said cylinder with said pipe and cylinder being substantially co-axial, and a universal joint pivotally interconnecting the lower end of said length of pipe at said fixed pivot point.

12. In said further improvement called for in claim 11 guide means mounted on the lower end of said lower piston rod so as to maintain said lower end approximately centered within said length of pipe.

13. In said further improvement as called for in claim 12, said guide means comprising a spider member with its hub mounted on said lower end and with a caster on the distal end of each spider arm rollably engaging the inner surface of said length of pipe as the same vertically reciprocates along with said reciprocable cylinder.

* * * * *

UNITED STATES PATENT AND TRADEMARK OFFICE

CERTIFICATE OF CORRECTION

PATENT NO. : 3,977,259
DATED : August 31, 1976
INVENTOR(S) : Harold A. Goldfein

It is certified that error appears in the above-identified patent and that said Letters Patent are hereby corrected as shown below:

Column 1, line 10, "pollish" should be --polish--.

Column 3, line 60, "At" should be --As--.

Column 4, line 26, "slighly" should be --slightly--.

Column 4, line 57, "cylsinder" should be --cylinder--.

Column 4, line 58, "generatlly" should be --generally--.

Column 5, line 54, "30'" should be --31'--.

Column 6, line 4, "members" should be --member--.

Column 6, line 29, "rom" should be --from--.

Column 7, line 35, "pint" should be --point--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*